US007771252B2

(12) United States Patent
Harter

(10) Patent No.: US 7,771,252 B2
(45) Date of Patent: Aug. 10, 2010

(54) APPARATUS FOR GRINDING AND/OR FINISHING A WORKPIECE

(75) Inventor: Ingo Harter, Wolfach (DE)

(73) Assignee: Supfina Grieshaber GmbH, Wolfach (DE)

( * ) Notice: Subject to any disclaimer, the term of this patent is extended or adjusted under 35 U.S.C. 154(b) by 11 days.

(21) Appl. No.: 11/964,118

(22) Filed: Dec. 26, 2007

(65) Prior Publication Data

US 2008/0102733 A1 May 1, 2008

Related U.S. Application Data

(63) Continuation of application No. PCT/EP2006/004714, filed on May 18, 2006.

(30) Foreign Application Priority Data

Jul. 7, 2005 (EP) ..... 05014721

(51) Int. Cl.
*B24B 7/00* (2006.01)

(52) U.S. Cl. ..... 451/170; 451/49; 451/213; 451/910

(58) Field of Classification Search ..... 451/49, 451/133, 170, 178, 199, 213, 264, 272, 305, 451/314, 320, 910
See application file for complete search history.

(56) References Cited

U.S. PATENT DOCUMENTS

| | | | | |
|---|---|---|---|---|
| 4,136,487 | A | 1/1979 | Khokhulin et al. | |
| 4,685,333 | A * | 8/1987 | Wilson et al. | 73/478 |
| 5,628,676 | A * | 5/1997 | Hoshizaki | 451/168 |
| 5,664,985 | A * | 9/1997 | Williams et al. | 451/5 |
| 5,741,174 | A * | 4/1998 | Kaiser et al. | 451/307 |
| 5,865,669 | A * | 2/1999 | Kiriyama et al. | 451/168 |
| 5,951,377 | A * | 9/1999 | Vaughn et al. | 451/49 |

FOREIGN PATENT DOCUMENTS

| | | |
|---|---|---|
| DE | 29 24 324 | 1/1980 |
| DE | 39 19 359 | 2/1990 |
| DE | 200 06 229 U | 10/2000 |

OTHER PUBLICATIONS

International Search Report for PCT/EP2006/004714.

* cited by examiner

*Primary Examiner*—Timothy V Eley
(74) *Attorney, Agent, or Firm*—Brinks Hofer Gilson & Lione

(57) ABSTRACT

The invention relates to a device (2) for grinding and/or finishing a workpiece (8) mounted on and/or in a workpiece mounting (22, 28). The workpiece (8) and the workpiece mounting (22, 28) may be set in an oscillating movement (86) by means of a drive device (60, 108) and form an oscillating unit (96) or part of an oscillating unit (96), at least one balancer unit (94) being provided which is driven to run counter to the oscillating movement (86) of the oscillating unit (96).

28 Claims, 5 Drawing Sheets

APPARATUS FOR GRINDING AND/OR FINISHING A WORKPIECE

CROSS-REFERENCE TO RELATED APPLICATIONS

This application is a continuation of International Application No. PCT/EP2006/004714 filed on May 18, 2006, which claims the benefit of EP 05 014 721.4, filed Jul. 7, 2005. The disclosures of the above applications are incorporated herein by reference.

FIELD

The invention relates to an apparatus for grinding and/or finishing a workpiece received on or in at least one workpiece mount.

BACKGROUND

The statements in this section merely provide background information related to the present disclosure and may not constitute prior art.

An apparatus of for grinding and/or finishing can be used to produce workpiece surfaces of high and maximum quality, as the workpieces driven by oscillations are machined by means of grinding wheels, abrasive belts or grindstones and/or by means of finishing wheels, belts or stones. In order to achieve short machining time and/or maximum surface quality, workpieces often oscillate at high frequencies.

The known apparatuses are associated with the problem that strong vibrations occur at high oscillation frequencies, the vibrations being introduced in the apparatus for grinding and/or finishing a workpiece and ultimately in the environment of the apparatus. It is possible to configure the machine base in a particularly rigid and heavy manner in order to reduce the vibrations that are introduced in the environment of the apparatus. This, however, results in heavy and consequently difficult-to-manage and consequently expensive apparatuses.

From DE 200 06 229 U1 it is known to drive a workpiece by oscillations by means of a sleeve that is displaceable in the axial direction. However, such an apparatus shows the disadvantage that vibrations are introduced into the environment of the apparatus as well. This problem is encountered particularly with extremely heavy workpieces, so that with workpieces of this type, for example at an oscillation stroke of +/−1.0 mm, an oscillation frequency is reached which is limited to just a few 100 $min^{-1}$.

SUMMARY

The present disclosure provides an apparatus for grinding and/or finishing a workpiece received on or in at least one workpiece mount, the apparatus enabling high oscillation frequencies.

This is achieved according to the disclosure in that at least one balancing unit is provided, which can be driven in the opposite direction to that of the oscillating movement of the oscillating unit.

As a result of the balancing unit driven in the opposite direction to that of the oscillating movement of the oscillating unit, the inertia forces created by the oscillating movements of the workpiece and workpiece mount can be compensated for in that inertia forces acting in the opposite direction to said inertia forces are produced. Components, such as the machine base of the apparatus, adjacent to the oscillating unit and the balancing unit are decoupled from the vibrations. This in turn shows the advantage that vibrations in the environment of the apparatus are reduced as well. Thus, at an oscillation stroke of +/−1.0 mm, very high oscillation frequencies in the range of 1500 $min^{-1}$ can be achieved.

According to an advantageous further development of the disclosure, the oscillating unit oscillates along a first axis and the balancing unit oscillates in a second axis that is parallel to the first axis. The parallelism of the axes provides that the inertia forces produced by the oscillating movements of the oscillating unit and balancing unit can be compensated for. The axes do not show to be configured physically; the axes are defined by the movements of the respective centers of gravity of the oscillating unit and balancing unit.

It is particularly advantageous if the first and second axes are coaxial to one another. In this way, the moments of inertia produced by the oscillating movements of the oscillating unit and of the balancing unit mutually compensate. This results in significantly reduced vibrations for the apparatus according to the disclosure and the environment thereof.

Compensation of forces and moments of inertia can be achieved particularly when the mass of the oscillating unit is equal to the mass of the balancing unit and when the oscillation stroke of the oscillating unit is equal to the oscillation stroke of the balancing unit. The oscillation stroke corresponds to the oscillation amplitude and amounts, for example, to several millimeters. It is also possible to compensate the inertia forces when the mass of the oscillating unit differs from the mass of the balancing unit. In this case, the oscillation strokes must be adjusted accordingly. For example, the mass of the oscillating unit is half of the mass of the balancing unit, wherein the oscillation stroke of the oscillating unit corresponds to double the oscillation stroke of the balancing unit.

The apparatus according to one form of the disclosure may comprise a headstock and/or a headstock support, a tailstock and/or a tailstock support and/or a rotational workpiece drive mechanism, wherein the above components may be part of the oscillating unit. It is therefore not necessary to minimize the mass of the oscillating unit, in fact, the above components can also oscillate together with the workpiece and the at least one workpiece mount. The appropriate compensation for the oscillating movements of an oscillating unit configured in this way can be provided by a balancing unit, whose stroke and/or mass are adjusted accordingly.

It is also possible to arrange the headstock and the tailstock on a common support, which is part of the oscillating unit. This is particularly advantageous for small workpieces.

Within the scope of the present disclosure, a workpiece mount shall be understood as a component that is suited to define the position and/or spatial position of a workpiece to be machined. Such a workpiece mount can be formed, for example, by a headstock support. It can also be provided as a workpiece mount that is configured as a tip or sleeve of a tailstock. For workpiece mounts of this type, it is advantageous to configure them such that they can be passively tracked in the direction of the workpiece, particularly if they are spring-actuated and/or piston-actuated. In this way, particularly oblong workpieces can be driven by oscillations at one end, while the other end can be passively tracked without requiring a further drive mechanism.

The balancing unit may comprise a balancing body. Said body can be made of, for example, a plurality of metal plates, which are detachably connected to one another. The balancing body advantageously shows fastening means for further masses.

If the balancing unit is provided with a balancing body support, the mass of the balancing unit can be adjusted particularly easily in that the balancing body, parts thereof or additional parts comprising masses are fastened to or on the support.

The balancing body and/or the headstock and/or the tailstock are advantageously guided in a linear fashion. The aforementioned components can thus oscillate freely in the longitudinal direction of the linear guide, thus ensuring that the components cannot build up any vibrations that are oriented transversely to the longitudinal axis of the guide. A linear guide is also suited for the balancing body support and/or the headstock support and/or the tailstock support and/or the common support for the headstock and tailstock in order to achieve the advantages mentioned above. In the case of linear guidance of the aforementioned supports, it is possible to adjust the apparatus to the geometry of a workpiece to be machined in an especially simple way, particularly to adjust the distance between the headstock and tailstock.

Even greater flexibility is achieved when the linear guide or the linear guides are provided on or in a sliding saddle, which is preferably mounted displaceable in relation to a machine base of the apparatus.

Within the scope of the present disclosure, it is possible that the drive mechanism, which causes the oscillating unit to oscillate, also drives the balancing unit. This shows the advantage that a further drive mechanism can be dispensed with, so that the apparatus shows fewer components in general.

For driving the balancing unit, however, an additional drive mechanism can also be provided, for example when high driving forces are required for particularly heavy workpieces.

One embodiment of the disclosure provides that the drive apparatus and/or the additional drive mechanism are configured as rotary drives. Particularly with such a rotary drive, the oscillating unit and/or the balancing unit can be driven by assigned connection rods, which are driven by common or different crank members. The crank members are provided with connection rod bearings offset eccentrically in relation to the axis of rotation of the crank member. The strokes of the oscillating unit and/or of the balancing unit are defined by the selection of the offset between the connection rod bearing and the axis of rotation of a crank member and by the length of the connection rod and the allocation thereof to the oscillating unit and/or balancing unit.

If a common crank member is provided for the different connection rods, which each drive the oscillating unit or balancing unit, a particularly simple drive mechanism can be formed for the oscillating unit and the balancing unit.

It is also possible, however, that different crank members are provided for driving the oscillating unit and for driving the balancing unit, as a result of which it is possible, for example, to spatially decouple the oscillating unit and the balancing unit from one another.

If individual drive mechanisms are not provided for the different crank members, the crank members can be coupled to one another by traction mechanisms, friction and/or gear wheels. In this way, the drive for the oscillating unit as well as the balancing unit can be accomplished with a drive mechanism and crank members that are spatially separated from one another.

The drive apparatus and/or additional drive mechanism may also comprise a linear drive, particularly a pneumatically or hydraulically actuated cylinder or a linear motor. Said drives do not translate a rotary movement into a linear, oscillating movement, but instead the oscillating movement is produced directly by the linear drive. Of course, the types of drives selected for the drive mechanism and additional drive mechanism do not show to be the same. For example, the drive apparatus can be configured as a rotary drive and the additional drive mechanism as a linear drive, or the additional drive mechanism can be a rotary drive and the drive apparatus a linear drive.

If the linear drive is provided with mechanical advancing units, such as ball screws, toothed belts and/or toothed racks, the arrangement of the linear drive and the transmission to the oscillating unit and/or the balancing unit is flexible with respect to space.

The linear drive can act along a lifting axis, which is coaxial to the axis along which the oscillating unit oscillates and/or coaxial to an axis in which the balancing unit oscillates. This shows the advantage that force transfer elements can be dispensed with.

The linear drive, however, can also act along a lifting axis which acts at an angle, particularly perpendicular to the oscillation axes of the oscillating unit and/or the balancing unit. This can be particularly advantageous when the space available in the longitudinal direction of the workpiece is limited, for example in the case of particularly long workpieces. In such a design, the linear drive may comprise a swivel and sliding joint, which drives the oscillating unit and/or the balancing unit via one or more push rods. In this way, the linear movement of the linear drive can be easily redirected into a different direction.

Within the scope of the present disclosure, it is also possible that the movements of the oscillating unit and the balancing unit are coupled to one another via movement transmission elements, particularly via levers, toothed racks, pinions, toothed belts, or scissor gears. In this way, it is possible to provide only one drive apparatus, which drives the oscillating unit, for example. The movement is then transferred to the balancing unit via the movement transmission elements. It is also possible, however, to drive the balancing unit by the drive apparatus and drive the oscillating unit by the balancing unit via the movement transmission elements. It is also conceivable that a drive apparatus can act on the movement transmission elements, which in turn drive the oscillating unit on the one hand, and the balancing unit on the other hand.

When using the aforementioned movement transmission elements, it is advantageous to provide at least one bearing point that is stationary in relation to the movements of the oscillating unit and balancing unit. In this way, particularly in the case of longer movement transmission elements, it can be prevented that these elements or the oscillating unit or the balancing unit connected thereto become destabilized by natural vibrations.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

In order that the invention may be well understood, there will now be described an embodiment thereof, given by way of example, reference being made to the accompanying drawing, in which.

DETAILED DESCRIPTION

The following description is merely exemplary in nature and is not intended to limit the present disclosure, application, or uses.

Figure 1:
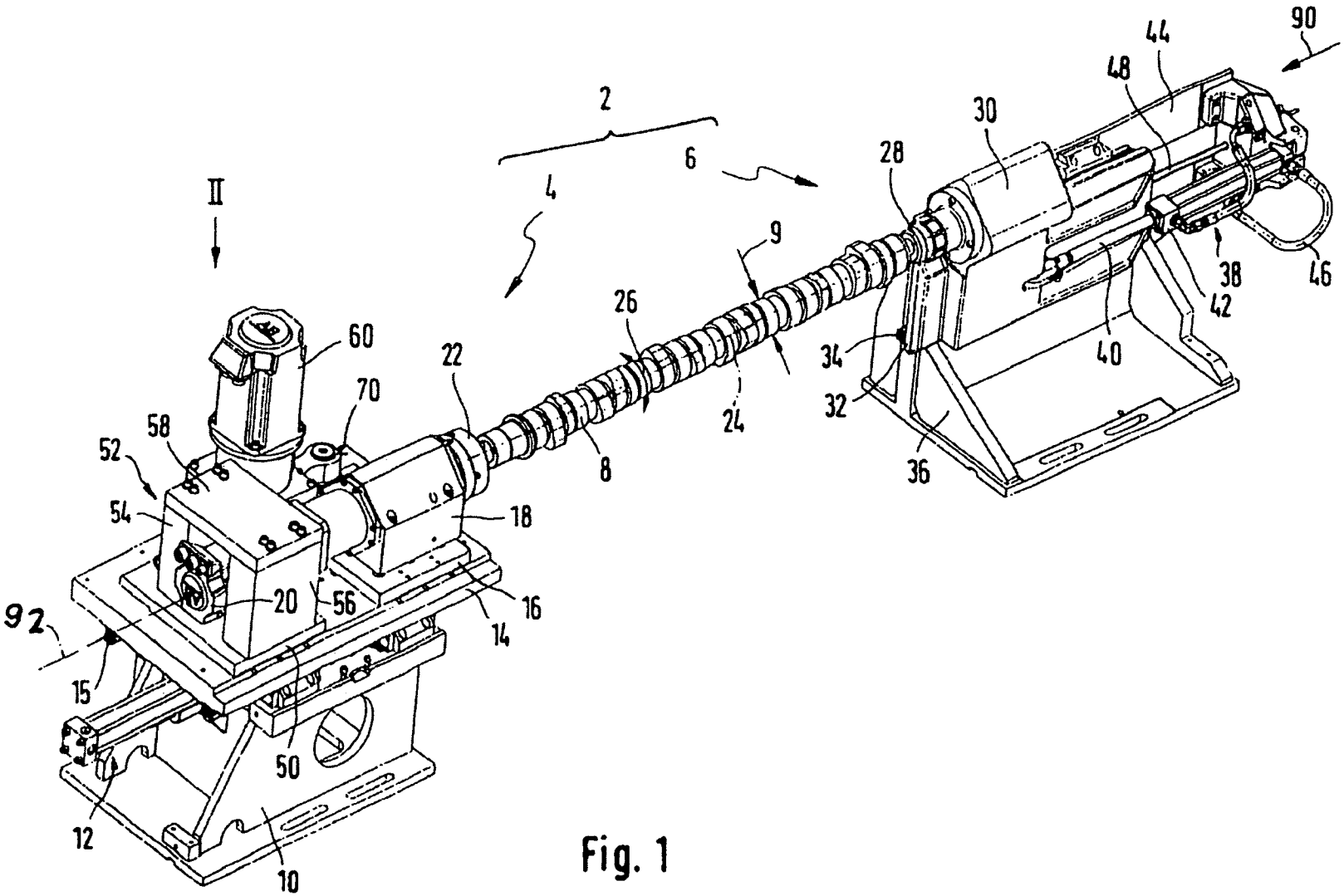
FIG. 1 is a perspective view of an apparatus according to the invention.

In FIG. 1, an apparatus for grinding and/or finishing a workpiece is designated overall by the reference numeral 2. The apparatus 2 shows a headstock side 4 shown on the left and a tailstock side 6 shown on the right. Between the headstock side 4 and tailstock side 6, an oblong workpiece 8 is received. The workpiece 8 can be machined by grinding and/or finishing when grinding and/or finishing means, which are not shown, such as belts or stones, press onto the workpiece 8 in a direction designated by the numeral 9.

The headstock side 4 shows a machine base 10, by means of which the headstock side 4 can be fixed relative to the environment of the apparatus 2. On the machine base 10 an infeed apparatus 12 is provided, which is configured as a lifting cylinder. By means of the infeed apparatus 12, a sliding saddle 14 can be adjusted in the direction of the tailstock side 6 or in a direction facing away from the tailstock side 6. For this purpose, the sliding saddle 14 is provided with a linear guide 15, by which the sliding saddle 14 is guided relative to the machine base 10.

On the sliding saddle 14 a plate-shaped headstock support 16 is provided, which is mounted likewise displaceable relative to the tailstock side 6. The headstock support 16 is used for the arrangement of a headstock 18, in which a spindle, which is not shown, is provided. Said spindle is driven rotatably by means of a rotary workpiece drive 20. On the side facing the workpiece 8, the spindle is provided with a workpiece mount 22, which is configured as a support. By means of the rotary workpiece drive 20, the workpiece mount 22 can rotatably drive the workpiece 8 such that it rotates about a workpiece axis 24 (both directions of rotation are possible, see reference numeral 26).

The workpiece 8 is mounted on the tailstock side 6 in a further workpiece mount 28 configured as a tip. The workpiece mount 28 is mounted rotatable in a tailstock 30, which is in turn arranged on a tailstock support 32. The tailstock support 32 can be displaced relative to a machine base 36 parallel to the workpiece axis 24 by means of the linear guides 34.

The tailstock support 32 and hence the tailstock 30 can be driven by a linear drive 38. The linear drive 38 is provided with a reciprocating piston 40 connected to the tailstock support 32, the piston being guided in a cylinder 42. The cylinder 42 is supported on a boom 44 of the machine base 36 and is supplied hydraulically via lines 46.

The position of the reciprocating piston 40 and hence of the tailstock support 32, of the tailstock 30 and the tip 28 can be detected by a positioning system 48, which is only shown schematically.

On the headstock side 4, on the side of the headstock 18 facing away from the tailstock side 6 a further plate-shaped support 50 is provided on the sliding saddle 14. Said support 50 can be displaced in directions parallel to the workpiece axis 24 in the direction of the tailstock side 6 or away from the same. For this purpose, the support 50 is provided with linear guides, which are not shown, and arranged parallel to the workpiece axis 24. On the support 50 a balancing body designated overall by the numeral 52 is fastened. Said body shows two substantially vertically extending plates 54 and 56, which are arranged on either side of the rotary workpiece drive 20. The plates 54 and 56 are connected to one another by a substantially horizontal plate 58.

Furthermore, on the headstock side 4 a drive apparatus 60 is provided, by which the headstock support 16 and the support 50 can be driven by oscillations. This will be described hereinafter with reference to FIGS. 2 to 5.

Figure 2:
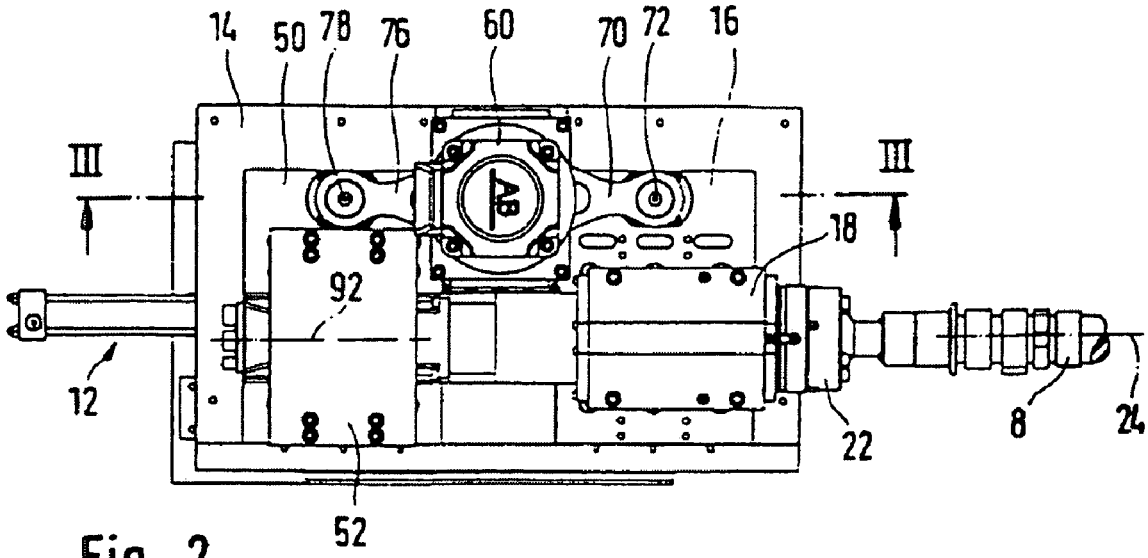
FIG. 2 is the apparatus according to FIG. 1 in a top view according to arrow II in FIG. 1.

FIG. 2 shows the headstock side 4 in a top view. Also shown is the sliding saddle 14, including the support 50 arranged thereon comprising the balancing body 52, and furthermore including the headstock support 16 for the headstock 18. The interaction between the drive apparatus 60 and the support 50 on the one hand, and the headstock support 16 on the other hand, will be described hereinafter in detail with reference to FIG. 3. The drive apparatus 60 shows a crank member 62, which is rotatably mounted in the drive apparatus 60 by means of a lower bearing 64 according to FIG. 3 and an upper bearing 66 according to FIG. 3. Between the bearings 64 and 66, the crank member 62 is provided with a first connection rod bearing 68 for a connection rod 70, which is also shown in FIGS. 2 and 1. The connection rod 70 is connected to the headstock support 16 via a pin element 72.

Between the bearings 64 and 66, adjacent to the first connection rod bearing 68, a second connection rod bearing 74 is provided for a second connection rod 76. The second connection rod 76 is also shown in FIG. 2. The second connection rod 76 is connected to the support 50 for the balancing body 52 via a second pin element 78. The angular offset of the connection rod bearings 68 and 74 relative to the crank member 62 is 180°.

Figure 3:
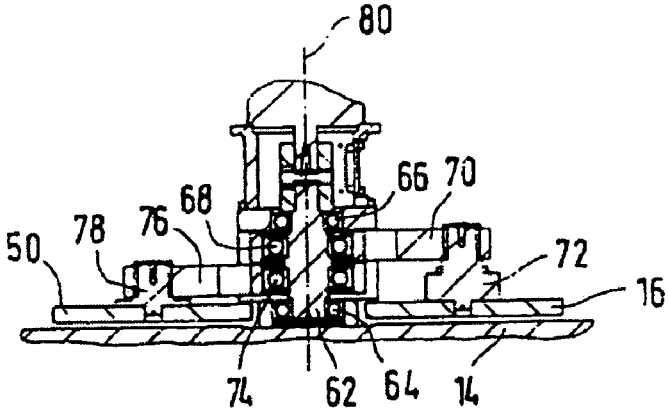
FIG. 3 is the apparatus according to FIG. 1 in a sectional view according to arrow III in FIG. 2.
Figure 4:
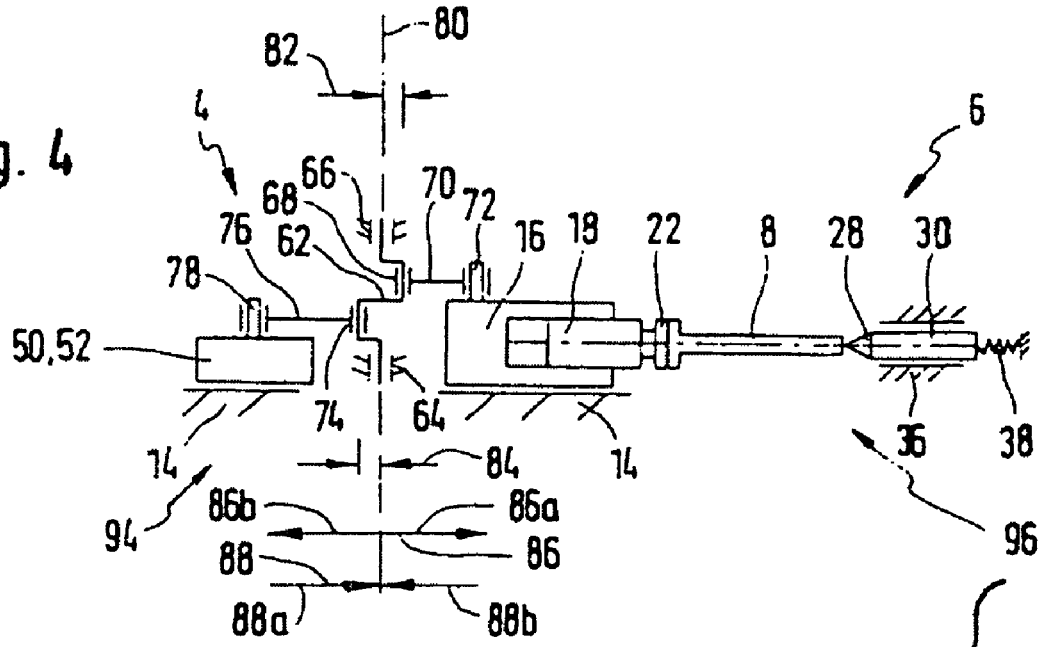
FIG. 4 is a schematic illustration corresponding to FIG. 3.
Figure 5:
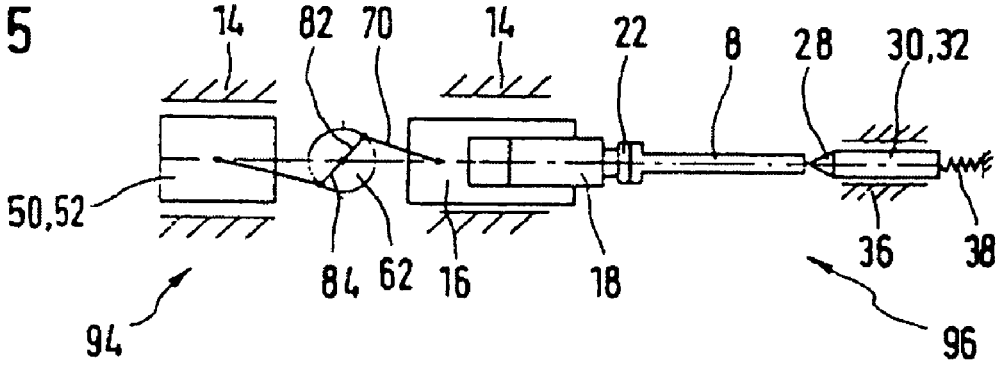
FIG. 5 is a schematic illustration corresponding to FIG. 2.

The design shown in FIG. 3 is schematically illustrated in FIGS. 4 and 5, the reference numerals having been transferred accordingly from FIGS. 1 to 3. For example, the sliding saddle 14 is only shown schematically as a stationary mount. For simplification purposes, the linear drive 38 is further shown as a spring. The crank member 62 illustrated schematically in FIG. 4 can rotate about an axis of rotation 80 upon actuation of the drive apparatus 60. The first connection rod bearing 68 of the connection rod 70 is offset by a dimension 82 in relation to said axis of rotation 80. Accordingly, the second connection rod bearing 74 for the connection rod 76 is offset from the axis of rotation 80 by the dimension 84. When the crank member 62 rotates, said rotary movement is transmitted via the connection rod 70 and the pin element 72 to the headstock support 16, which is mounted displaceable relative to the sliding saddle 14 such that the headstock support 16 performs an oscillating movement designated by the numeral 86. The headstock support 16 can perform a forward stroke designated by the numeral **86*a* in the direction of the tailstock side 6, which is followed by a return stroke 86*b*. The forward stroke 86*a* and the return stroke 86*b* correspond to the oscillation stroke and amount to double the offset 82**.

The connection rod 76, which drives the support 50 for the balancing body 52 via the pin element 78, is also driven by the rotation of the crank member 62. The rotation of the crank member 62 is therefore translated into an oscillating movement 88 of the support 50 with the balancing body 52. The support 50 with the balancing body 52 can perform a forward stroke **88*a* in the direction of the tailstock side 6 or a return stroke 88*b*. The forward stroke 88*a* and the return stroke 88*b*** correspond to the oscillation stroke of the support 50. Said stroke amounts to double the offset 84.

The headstock support 16, the headstock 18, the rotary workpiece drive 20, the workpiece mount 22, the workpiece 8, the workpiece mount 28, the tailstock 30, and the tailstock support 32 form an oscillating unit, which is designated overall by the reference numeral 96 in FIGS. 4 and 5. Said unit 96 is driven by the drive apparatus 60. In order to guarantee secure retention of the workpiece 8 between the workpiece mounts 22 and 28 even during a return stroke 86*b* of the headstock 18, the linear drive 38 is prestressed such that it builds up a tension force, which is designated by the numeral 90 in FIG. 1 and acts in the direction of the workpiece 8.

The support 50 and the balancing body 52 form a balancing unit, which in FIGS. 4 and 5 is designated overall by the reference numeral 94. During an oscillating movement of the oscillating unit 96, which is composed as described above, the balancing unit 94 oscillates too. The movements of the oscillating unit 96 and balancing unit 94 act in opposite direction to one another. Thus, if the oscillating unit 96 performs a forward stroke 86*a*, the balancing unit 94 at the same time performs a return stroke 88*b*. If during further rotation of the crank member 62 the oscillating unit 96 performs a return stroke 86*b*, the balancing unit 94 is moved in the opposite direction with a forward stroke 88*a*.

The support 50 and the balancing body 52 oscillate along an axis 92 shown in FIGS. 1 and 2. The axis 92 is arranged coaxial to the workpiece axis 24, in which the oscillation movement 86 of the oscillating unit 96 takes place.

In the exemplary embodiment shown in FIGS. 1 to 5, the geometry of the drive of the oscillating unit 96 (offset 82, length of the connection rod 70) corresponds to the geometry of the drive of the balancing unit 94 (offset 84, length of the connection rod 76). This means that the oscillation stroke of the oscillating unit 96 is equal to the oscillation stroke of the balancing unit 94. To achieve ideal compensation for the vibrations produced by the oscillating movement of the oscillating unit 96, the oscillating unit 96 shows the same mass as the balancing unit 94. The workpiece 8 is part of the oscillating unit 96. If another workpiece that shows a different weight is to be machined, the balancing unit 94 can be adapted accordingly by accordingly adding or removing weight to or from the balancing body 52.

Figure 6:
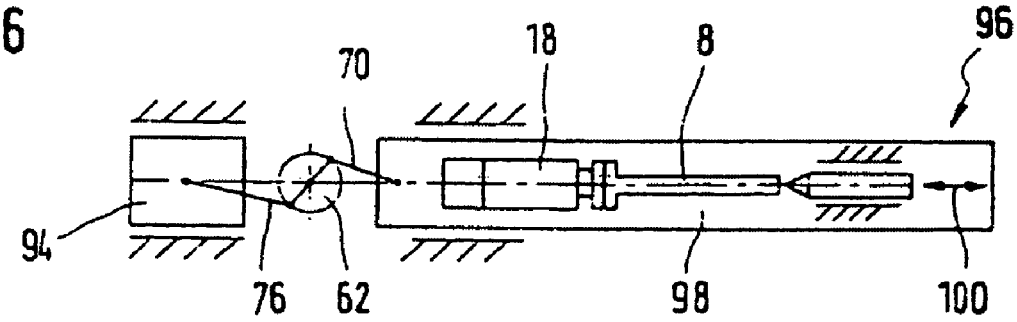
FIGS. 6-11 are further embodiments of inventive apparatuses.

With reference to FIG. 6, a further embodiment of the invention will be described hereinafter. It is similar in design to the apparatus according to FIGS. 1 to 5. For example, a crank member 62 is provided, which can be driven rotatably by a drive apparatus, which is not shown, in order to drive a balancing unit, designated overall by the numeral 94, by oscillations via a connecting rod 76. The crank member 62 acts on an oscillating unit designated overall by the reference numeral 96 via a connection rod 70. The unit shows an oblong support 98, which replaces the headstock support 16 and tailstock support 32 that are shown in FIGS. 1 to 5. The headstock 18 and the tailstock 30 are fastened on the common support 98. In order to enable an adjustment to the length of the workpiece 8, the tailstock 30 is displaceable relative to the common support 98, which is indicated by the double arrow 100.

Figure 7:
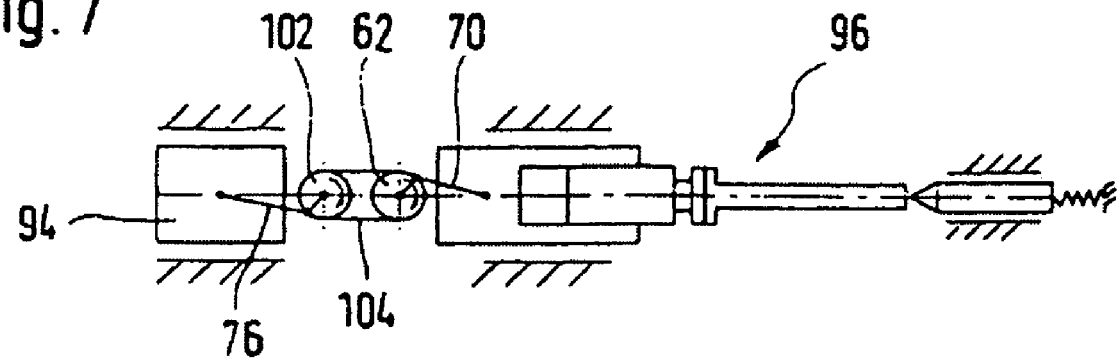

The embodiment according to FIG. 7 is comparable to the embodiment according to FIGS. 1 to 5. The oscillating unit 96 shown in FIG. 7 corresponds to the oscillating unit according to FIG. 5, which shows a headstock support 16, headstock 18, workpiece mount 22, workpiece 8, tip 28, tailstock 30, and tailstock support 32. The balancing unit 94 shown on the left in FIG. 7 can, as is shown in FIG. 5, comprise a support 50 and a balancing body 52.

In the embodiment according to FIG. 7, a drive apparatus, which is not shown, drives a first crank member 62, which causes the oscillating unit 96 to oscillate via a connection rod 70. In addition to the first crank member 62, a second crank member 102 is provided, which is driven by the first crank member 62 via a traction mechanism 104 configured as a belt drive. Thus, the crank member 102 can cause the balancing unit to oscillate via the connecting rod 76, the oscillation acting in opposite direction to the oscillating movement of the oscillating unit 96.

Figure 8:
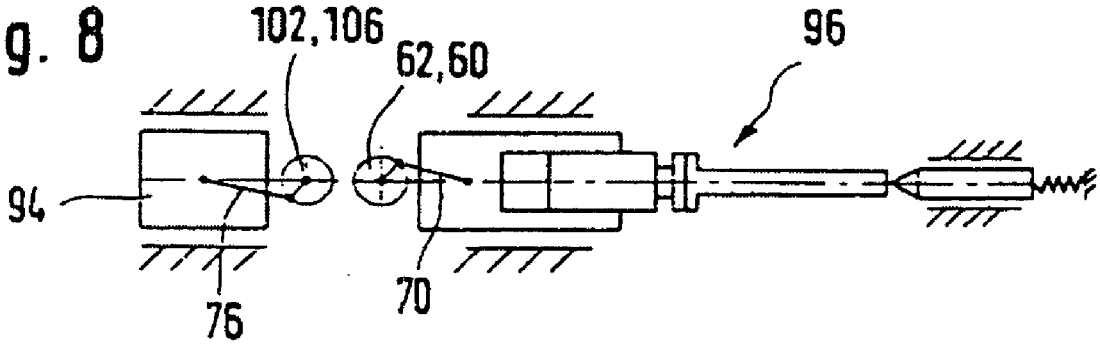

In the embodiment according to FIG. 8, an additional crank member 102 is also provided. Each crank member 62 and 102 is driven by an individual drive mechanism, that is, the crank member 62 is driven by a drive apparatus 60, which is not shown in detail, and the crank member 102 by an additional drive, which is not shown in detail. The embodiment according to FIG. 8 shows the advantage that a spatial separation is possible between the oscillating unit 96 and the balancing unit 94. It is necessary, however, to coordinate the drive mechanisms 60 and 106 with one another via a suitable controller in order to ensure that the movement of the balancing unit 94 is in the opposite direction to the movement of the oscillating unit 96.

Figure 9:
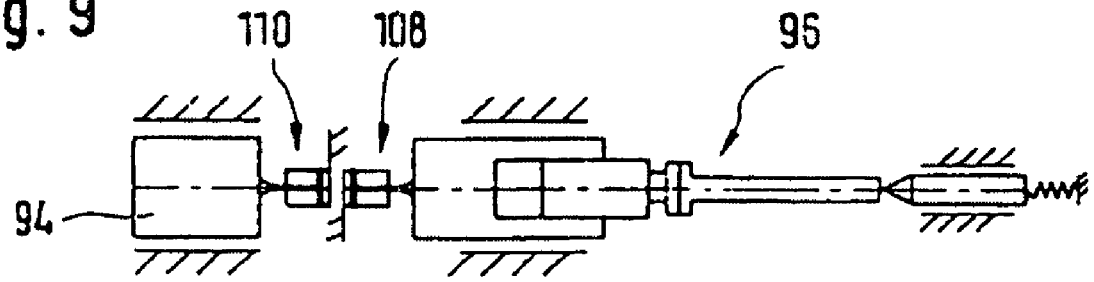
Figure 10:
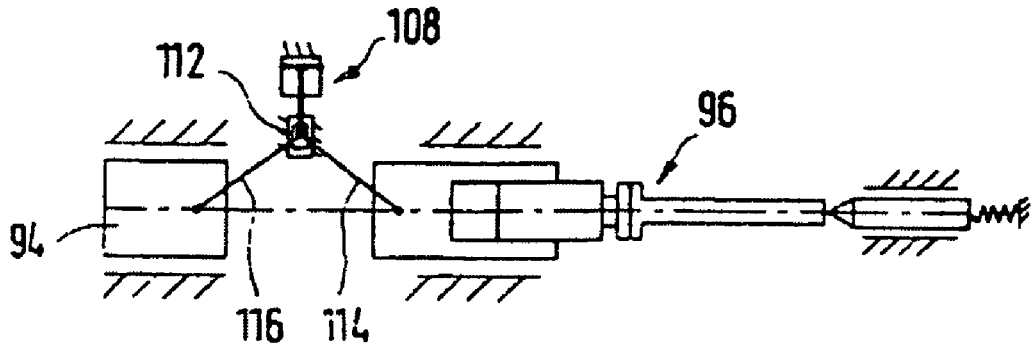

The previously described drive apparatuses and additional drives were rotary drives. In FIGS. 9 and 10, configurations are proposed which are based on linear drives. In FIG. 9, for example, a balancing unit is designated overall by the reference numeral 94, and an oscillating unit overall by the numeral 96. The oscillating unit 96 is driven by a first linear drive 108, which forms the drive apparatus for the oscillating unit 96. In order to drive the balancing unit 94, an additional drive is provided in the form of a second linear drive 110. The linear drives 108 and 110 can be formed, for example, by hydraulically actuated cylinders. By suitable activation, opposing movements of the linear drives 108 and 110 and hence of the oscillating unit 96 and balancing unit 94 can be produced.

In the embodiment according to FIG. 10, only one linear drive 108 is required as a drive apparatus. Via a swivel and sliding joint 112, said apparatus drives a first push rod 114 acting on an oscillating unit 96. The swivel and sliding joint acts on a balancing unit 94 via a second push rod 116.

Figure 11:
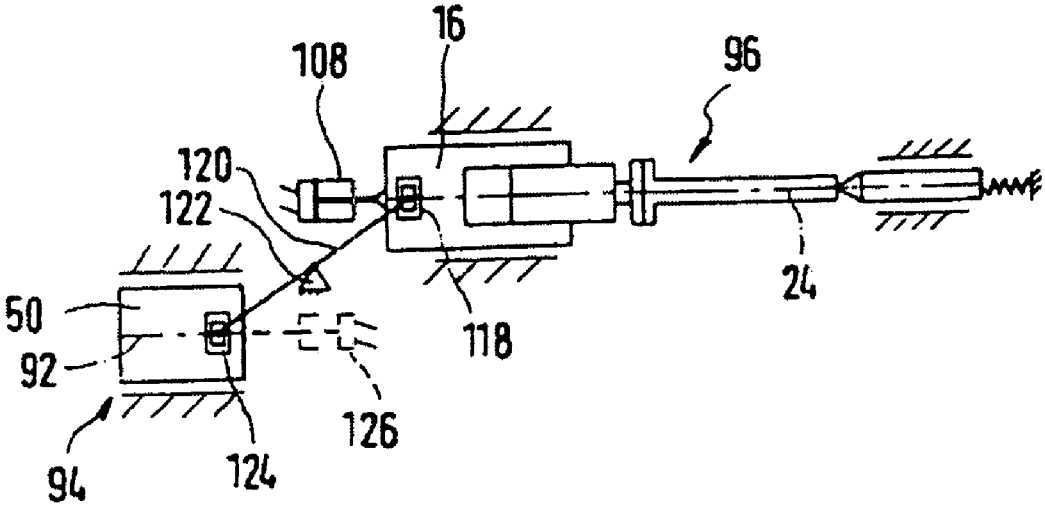

Finally, FIG. 11 shows an embodiment wherein the drive apparatus of an oscillating unit 96 is formed by a linear drive 108. The apparatus drives a headstock support 16 by oscillations and coaxial to a workpiece axis 24. The headstock support 16 shows a swivel and sliding joint 118, which is coupled to a lever 120. The lever 120 shows a stationary mount 122 arranged at the center of the length of the lever 120. On the side opposite to the swivel and sliding joint 118, the lever 120 shows a further swivel and sliding joint 124, which is provided on the support 50 of the balancing unit 94. The balancing unit is therefore driven causally by the linear drive 108, however by interconnecting the oscillating unit 96. The oscillating unit 96 oscillates along the workpiece axis 24 and the balancing unit 94 oscillates in an axis 92 parallel to the workpiece axis 24. An additional drive 126 for the balancing unit 94, the drive being indicated with dotted lines in FIG. 11, is not required, but may be provided.

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. An apparatus for grinding and/or finishing a workpiece received on or in at least one workpiece mount, the workpiece and the workpiece mount being caused to perform an oscillating movement by a drive apparatus and forming an oscillating unit or part of an oscillating unit, characterized in that at least one balancing unit is provided, which can be driven in an opposite direction to the oscillating movement of the oscillating unit, in that the oscillating unit oscillates along a workpiece axis and in that the balancing unit oscillates in a second axis parallel and coaxial to the workpiece axis.

2. The apparatus according to claim 1, characterized in that a mass of the oscillating unit is approximately equal to a mass of the balancing unit and that an oscillation stroke of the oscillating unit is approximately equal to an oscillation stroke of the balancing unit.

3. The apparatus according to claim 1, characterized in that the apparatus further comprises at least one of a headstock and/or a headstock support, a tailstock and/or a tailstock support, and a rotary workpiece drive, which are part of the oscillating unit.

4. The apparatus according to claim 3, characterized in that the headstock and the tailstock are disposed on a common support, which is part of the oscillating unit.

5. The apparatus according to claim 3, characterized in that a workpiece mount is provided on the headstock, the workpiece mount being configured in particular as a carrier.

6. The apparatus according to claim 3, characterized in that a workpiece mount is provided on the tailstock, the workpiece mount being configured in particular as a tip or sleeve.

7. The apparatus according to claim 3, characterized in that the balancing unit comprises a balancing body support.

8. The apparatus according to claim 7, characterized in that at least one of the balancing body, the headstock, and the tailstock are linearly guided.

9. The apparatus according to claim 8, characterized in that the linear guiding is provided on or in a sliding saddle.

10. The apparatus according to claim 9, characterized in that the sliding saddle is mounted displaceable relative to a machine base of the apparatus.

11. The apparatus according to claim 7, characterized in that at least one of the balancing body support, the headstock support, the tailstock support, a common support for the headstock, and the tailstock are linearly guided.

12. The apparatus according to claim 1, characterized in that a workpiece mount can be passively tracked in the direction of the workpiece.

13. The apparatus according to claim 1, characterized in that the balancing unit comprises a balancing body.

14. The apparatus according to claim 1, characterized in that the drive apparatus drives the balancing unit.

15. The apparatus according to claim 1, characterized in that an additional drive is provided for driving the balancing unit.

16. The apparatus according to claim 1, characterized in that the drive apparatus comprises a rotary drive.

17. The apparatus according to claim 1, characterized in that the oscillating unit is driven by a connection rod, which is driven by a crank member.

18. The apparatus according to claim 17, characterized in that a common crank member is provided for driving the oscillating unit and for driving the balancing unit.

19. The apparatus according to claim 17, characterized in that different crank members are provided for driving the oscillating unit and for driving the balancing unit.

20. The apparatus according to claim 19, characterized in that the crank members are coupled to one another via at least one of traction mechanisms and friction and/or gear wheels.

21. The apparatus according to claim 1, characterized in that the balancing unit is driven by a connection rod, which is driven by a crank member.

22. The apparatus according to claim 1, characterized in that at least one of the drive apparatus and the additional drive comprises a linear drive.

23. The apparatus according to claim 22, characterized in that the linear drive is provided with mechanical advancing units.

24. The apparatus according to claim 22, characterized in that the linear drive acts along a lifting axis arranged coaxial to at least one of the first axis and the second axis.

25. The apparatus according to claim 22, characterized in that the linear drive acts along a lifting axis arranged at an angle.

26. The apparatus according to claim 25, characterized in that the linear drive comprises a swivel and sliding joint, which drives at least one of the oscillating unit and the balancing unit via at least one push rod.

27. An apparatus according to claim 1, characterized in that the movements of the oscillating unit and of the balancing unit are coupled to one another via movement transmission elements.

28. The apparatus according to claim 27, characterized in that the movement transmission elements are provided with at least one bearing point that is stationary in relation to the movements of the oscillating unit and balancing unit.

* * * * *